US009997866B1

(12) United States Patent
Hsu

(10) Patent No.: US 9,997,866 B1
(45) Date of Patent: Jun. 12, 2018

(54) WATERPROOF CONNECTOR

(71) Applicant: Cheng Uei Precision Industry Co., Ltd., New Taipei (TW)

(72) Inventor: Li-Nien Hsu, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days. days.

(21) Appl. No.: 15/822,083

(22) Filed: Nov. 24, 2017

(51) Int. Cl.

| | |
|---|---|
| ***H01R 13/58*** | (2006.01) |
| ***H01R 13/52*** | (2006.01) |
| ***H01R 13/504*** | (2006.01) |
| *H01R 13/41* | (2006.01) |
| *H01R 24/60* | (2011.01) |
| *H01R 13/6585* | (2011.01) |
| *H01R 13/405* | (2006.01) |
| *H01R 43/24* | (2006.01) |

(52) U.S. Cl.
CPC ..... *H01R 13/5202* (2013.01); *H01R 13/504* (2013.01); *H01R 13/5219* (2013.01); *H01R 13/405* (2013.01); *H01R 13/41* (2013.01); *H01R 13/6585* (2013.01); *H01R 24/60* (2013.01); *H01R 43/24* (2013.01)

(58) Field of Classification Search
USPC ..... 439/606, 718, 736
See application file for complete search history.

(56) References Cited

U.S. PATENT DOCUMENTS

| | | | | |
|---|---|---|---|---|
| 8,348,688 | B2 * | 1/2013 | Liu | H01R 13/5219 439/271 |
| 8,662,928 | B1 * | 3/2014 | Xie | H01R 13/6594 439/607.35 |
| 9,871,318 | B2 * | 1/2018 | Wang | H01R 13/5202 |
| 2016/0093974 | A1 * | 3/2016 | Lai | H01R 13/5202 439/736 |

* cited by examiner

*Primary Examiner* — Tho D Ta
(74) *Attorney, Agent, or Firm* — Cheng-Ju Chiang

(57) ABSTRACT

A waterproof connector includes an insulating housing, a plurality of terminals integrally molded to the insulating housing, a metal shell and a waterproof housing. A rear of the insulating housing opens a penetrating groove. Each of the plurality of the terminals has a fastening portion, a contact portion and a soldering portion. The metal shell surrounds the insulating housing. The waterproof housing is integrally molded outside the metal shell by a liquid silicone rubber technology. The waterproof housing includes a main portion surrounding outside the metal shell, and a partition portion integrally molded in the penetrating groove, so that the partition portion fills in and effectively seals up intervals among rear ends of the fastening portions and the insulating housing. The waterproof housing has multiple sealing rings of which each surrounds a periphery of a front end of the waterproof housing.

18 Claims, 7 Drawing Sheets

WATERPROOF CONNECTOR

BACKGROUND OF THE INVENTION

1. Field of the Invention

The present invention generally relates to a connector, and more particularly to a waterproof connector.

2. The Related Art

Nowadays, a current electronic device or a current transmission equipment generally has a connector for transmitting data or charging. The current electronic device or the current transmission equipment has a shell which opens an opening. The connector is disposed in the shell of the current electronic device or the current transmission equipment and exposed to the opening of the shell for facilitating a connection between the connector of the current electronic device or the current transmission equipment and a docking connector of another electronic device or another transmission equipment. However when the current electronic device or the current transmission equipment is located in an outside usage environment, a raining usage environment or a high humidity usage environment, an electrical characteristic and a usage life of the connector of the current electronic device or the current transmission equipment are apt to be affected on account of moistures and liquids in the usage environment permeating into the connector of the current electronic device or the current transmission equipment.

Thus how to improve the above-mentioned problems by virtue of a structure design has become an important issue which is to be solved by skilled persons in the art, so an innovative waterproof connector having a reasonable design and effectively improving the above-mentioned problems is needed to be provided.

SUMMARY OF THE INVENTION

An object of the present invention is to provide a waterproof connector. The waterproof connector includes an insulating housing, a plurality of terminals, a metal shell and a waterproof housing. A rear of the insulating housing opens a penetrating groove vertically penetrating through the insulating housing. The plurality of terminals are integrally molded to the insulating housing. Each of the plurality of the terminals has a fastening portion, a contact portion connected with a front end of the fastening portion, and a soldering portion connected with a rear end of the fastening portion. The penetrating groove is opened corresponding to the rear ends of the fastening portions and located in front of the soldering portions. The metal shell surrounds the insulating housing to which the plurality of the terminals are integrally molded. The waterproof housing is integrally molded outside the metal shell by a liquid silicone rubber technology. The waterproof housing includes a main portion surrounding outside the metal shell, and a partition portion integrally molded in the penetrating groove, so that the partition portion fills in and effectively seals up intervals among the rear ends of the fastening portions and the insulating housing which are located in the metal shell. The waterproof housing has multiple sealing rings of which each surrounds a periphery of a front end of the waterproof housing. The main portion, the partition portion and the multiple sealing rings are integrally molded by the liquid silicone rubber technology.

As described above, the waterproof housing is integrally molded outside the metal shell by the liquid silicone rubber technology, the main portion of the waterproof housing surrounds outside the metal shell, the waterproof housing has the multiple sealing rings of which each surrounds the periphery of the front end of the waterproof housing, the multiple sealing rings are longitudinally arranged in sequence and provide the multiple waterproof protections so as to reinforce and ensure that the waterproof function between an outside of the waterproof connector and an enclosure of an electronic product is normal. Simultaneously, the partition portion of the waterproof housing is integrally molded in the penetrating groove, so that the partition portion fills in and effectively seals up the intervals among the rear ends of the fastening portions and the insulating housing which are located in the metal shell for further ensuring a waterproof function of an insertion space of the waterproof connector is normal. As a result, moistures and liquids in a usage environment are ensured to be prevented from permeating into the waterproof connector to affect an electrical characteristic and a usage life of the waterproof connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
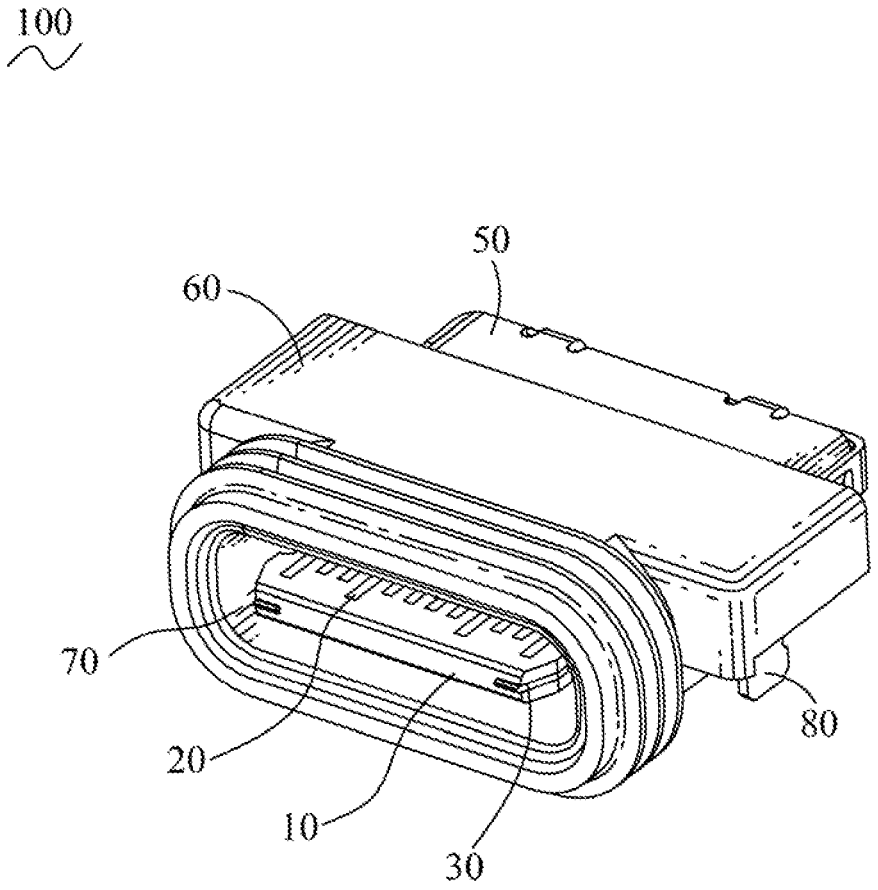
FIG. 1 is a perspective view of a waterproof connector in accordance with the present invention.
Figure 2:
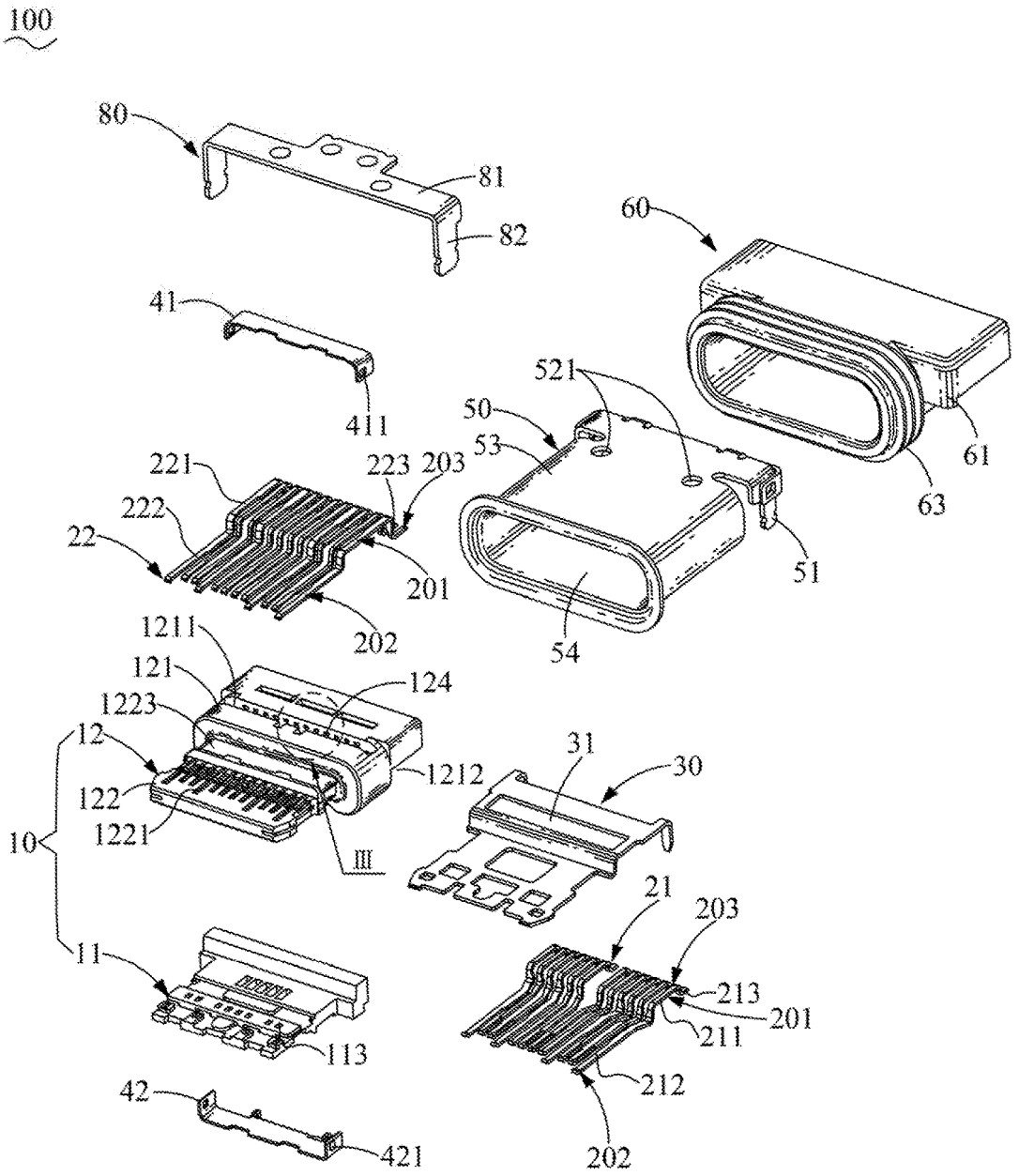
FIG. 2 is an exploded perspective view of the waterproof connector of FIG. 1.
Figure 3:
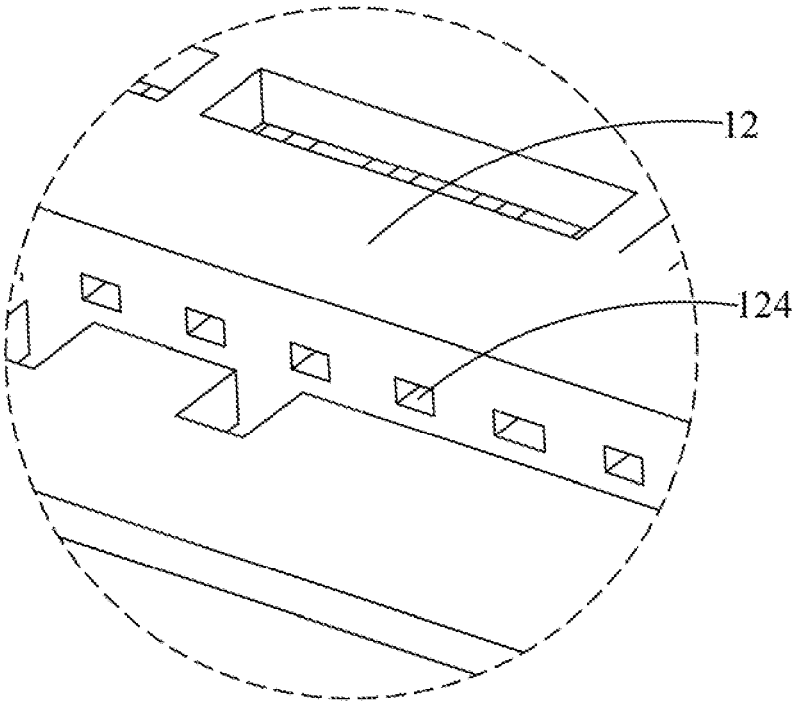
FIG. 3 is an enlarged view of an encircled portion III of the waterproof connector of FIG. 2.
Figure 4:
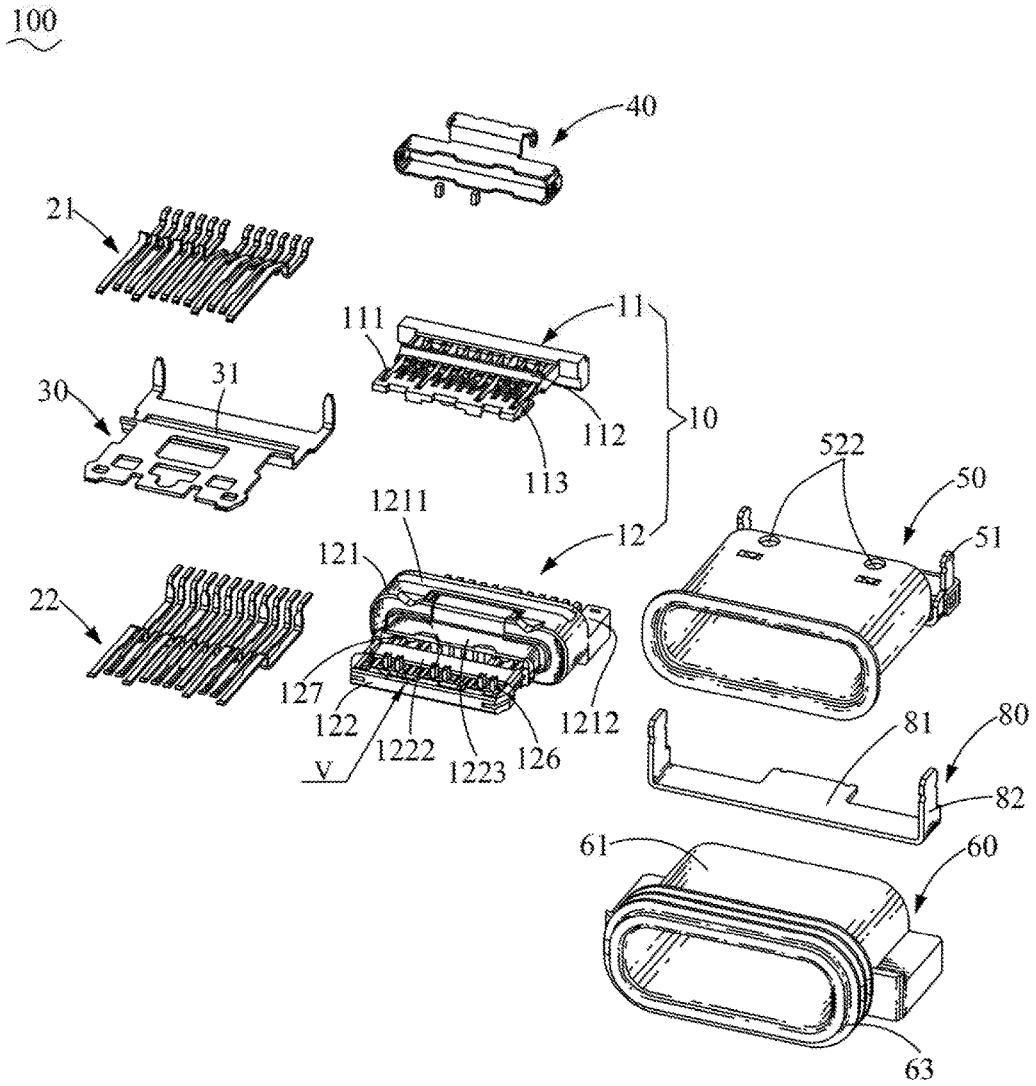
FIG. 4 is another exploded perspective view of the waterproof connector of FIG. 1.

With reference to FIG. 1 to FIG. 4, a waterproof connector 100 in accordance with the present invention is shown. The waterproof connector 100 includes an insulating housing 10, a plurality of terminals 20, an isolating plate 30, a shielding plate assembly 40, a metal shell 50 and a waterproof housing 60.

Figure 5:
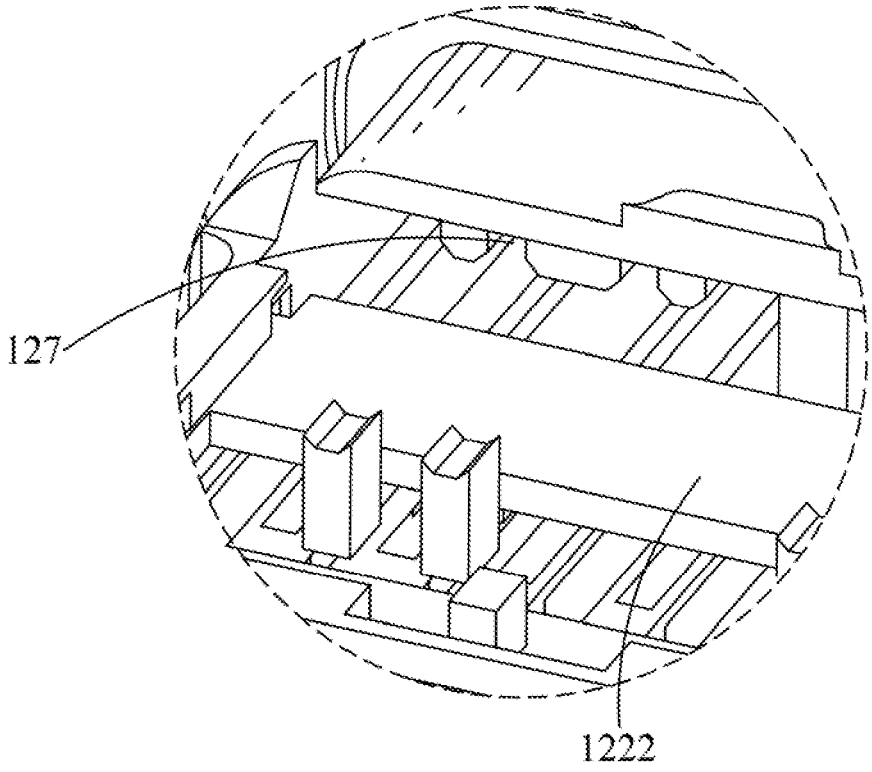
FIG. 5 is an enlarged view of an encircled portion V of the waterproof connector of FIG. 4.
Figure 6:
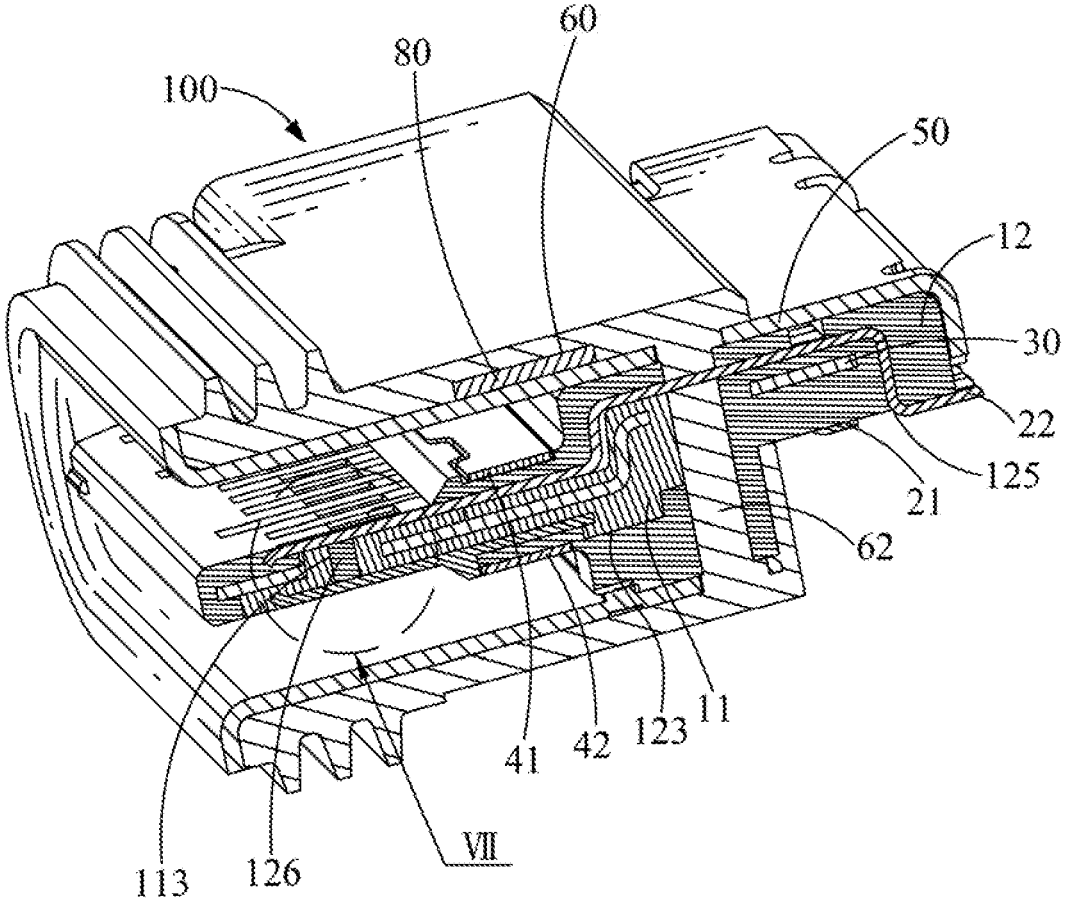
FIG. 6 is a sectional perspective view of the waterproof connector of FIG. 1.
Figure 7:
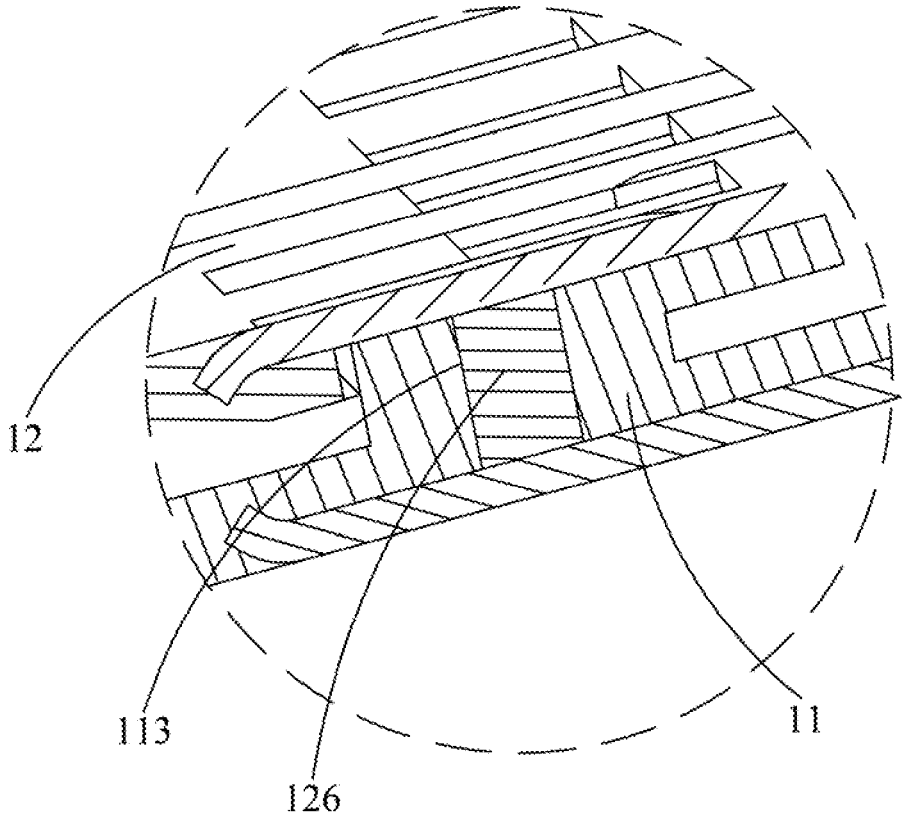
FIG. 7 is an enlarged view of an encircled portion VII of the waterproof connector of FIG. 6.

Referring to FIG. 1 to FIG. 7, the insulating housing 10 includes a dielectric body 11 and an outer insulating body 12. A rear of the insulating housing 10 opens a penetrating groove 1211 vertically penetrating through the insulating housing 10. The dielectric body 11 defines a plurality of lower terminal grooves 111 penetrating through a bottom surface and a rear surface of the dielectric body 11. A substantial middle of the bottom surface of the dielectric body 11 protrudes downward to form a blocking portion 112 projecting beyond the bottom surface of the dielectric body 11. The plurality of the lower terminal grooves 111 are located under the blocking portion 112. The outer insulating body 12 has a base portion 121, and a tongue portion 122 protruded frontward from a middle of a front surface of the base portion 121. A middle of a front of the base portion 121 opens a receiving space 123 extending frontward into a middle of a rear of the tongue portion 122. A front wall of the receiving space 123 opens a plurality of fastening slots 127 arranged transversely and communicated with the receiving space 123. Bottom walls of the plurality of the lower terminal grooves 111 open a plurality of locating holes 113 vertically penetrating through the bottom walls of the plurality of the lower terminal grooves 111. The outer insulating body 12 opens a plurality of upper terminal grooves 1221 penetrating through a front of a top surface of the tongue portion 122 and extending to the front of the base portion 121. The plurality of the upper terminal grooves 1221 are communicated with the receiving space 123.

A front of a bottom surface of the tongue portion 122 opens an opening 1222 communicated with the receiving space 123 by the plurality of the fastening slots 127. A rear of a peripheral surface of the tongue portion 122 is recessed inward to form a limiting groove 1223. The base portion 121 opens the penetrating groove 1211 penetrating through a top surface and a bottom surface of the base portion 121. A rear of the bottom surface of the base portion 121 is recessed inward to form an assembling groove 1212 passing through a rear surface of the base portion 121. An upper portion of a rear of the base portion 121 opens a plurality of upper fixing holes 124 arranged transversely and communicated with the penetrating groove 1211. The plurality of the upper fixing holes 124 vertically penetrate through a rear of a top wall of the assembling groove 1212. A lower portion of the rear of the base portion 121 opens a plurality of lower fixing holes 125 arranged transversely and communicated with the penetrating groove 1211. The plurality of the lower fixing holes 125 vertically penetrate through a front of the top wall of the assembling groove 1212. Tail ends of the lower fixing holes 125 are located in front of tail ends of the upper fixing holes 124. Several portions of a bottom surface of a top wall of the opening 1222 protrude downward to form a plurality of locating portions 126.

Referring to FIG. 1 to FIG. 4, the plurality of terminals 20 are integrally molded to the insulating housing 10. The plurality of the terminals 20 include a plurality of lower terminals 21 arranged transversely, and a plurality of upper terminals 22 arranged transversely. Each of the plurality of the terminals 20 has a fastening portion 201, a contact portion 202 connected with a front end of the fastening portion 201, and a soldering portion 203 connected with a rear end of the fastening portion 201. The contact portions 202 are exposed to a front of the insulating housing 10 and arranged in two rows. The soldering portions 203 project out of a rear of the insulating housing 10.

Specifically, each of the plurality of the lower terminals 21 has a lower fastening portion 211, a lower contact portion 212 connected with a front end of the lower fastening portion 211, and a lower soldering portion 213 connected with a rear end of the lower fastening portion 211. Each of the plurality of the upper terminals 22 has an upper fastening portion 221, an upper contact portion 222 connected with a front end of the upper fastening portion 221, and an upper soldering portion 223 connected with a rear end of the upper fastening portion 221. The penetrating groove 1211 is opened corresponding to the rear ends of the fastening portions 201 of the plurality of the terminals 20 and located in front of the soldering portions 203 of the plurality of the terminals 20.

Referring to FIG. 1 to FIG. 7, the isolating plate 30 is disposed above the plurality of the lower terminals 21. The isolating plate 30 and the plurality of the lower terminals 21 are together integrally molded to the dielectric body 11. The dielectric body 11 is molded in the opening 1222 and the receiving space 123. The lower contact portions 212 of the plurality of the lower terminals 21 are exposed to the plurality of the lower terminal grooves 111. The front ends of the lower fastening portions 211 of the plurality of the lower terminals 21 are integrally molded in the dielectric body 11. The rear ends of the lower fastening portions 211 and the lower soldering portions 213 of the plurality of the lower terminals 21 project beyond the rear surface of the dielectric body 11. The isolating plate 30 opens an avoiding groove 31 corresponding to the penetrating groove 1211. The plurality of the upper terminals 22 are disposed to a top of the dielectric body 11 and arranged transversely.

The plurality of the upper terminals 22 are disposed above the isolating plate 30. The plurality of the upper terminals 22 together with the dielectric body 11, the isolating plate 30 and the plurality of the lower terminals 21 are together integrally molded in the outer insulating body 12. The isolating plate 30 is located between the plurality of the upper terminals 22 and the plurality of the lower terminals 21. The penetrating groove 1211 is located at a rear end of the dielectric body 11. The upper contact portions 222 of the plurality of the upper terminals 22 are exposed to the plurality of the upper terminal grooves 1221 through the plurality of fastening slots 127. The rear ends of the lower fastening portions 211 of the plurality of the lower terminals 21 and the upper fastening portions 221 of the plurality of the upper terminals 22 are integrally molded in the outer insulating body 12. The upper soldering portions 223 of the plurality of the upper terminals 22 and the lower soldering portions 213 of the plurality of the lower terminals 21 pass through the plurality of the upper fixing holes 124 and the plurality of the lower fixing holes 125, respectively. The upper soldering portions 223 of the plurality of the upper terminals 22 and the lower soldering portions 213 of the plurality of the lower terminals 21 project under a rear of the outer insulating body 12 and are exposed to the assembling groove 1212. The blocking portion 112 is blocked by a rear wall of the opening 1222. The plurality of the locating portions 126 are located in the plurality of the locating holes 113.

Referring to FIG. 1 to FIG. 4, the metal shell 50 is of a hollow rectangular shape. The metal shell 50 surrounds the insulating housing 10 to which the plurality of the terminals 20 and the isolating plate 30 are integrally molded. A front of the metal shell 50 is spaced from the dielectric body 11 and the tongue portion 122 of the outer insulating body 12 to form an insertion space 70. Two opposite sides of a rear of the metal shell 50 protrude downward to form two soldering feet 51. The metal shell 50 has a top plate 53, and a bottom plate 54 opposite to the top plate 53. A middle of a rear end of the top plate 53 opens at least one first avoiding hole 521. A middle of a rear end of the bottom plate 54 opens at least one second avoiding hole 522. In this preferred embodiment, the middle of the rear end of the top plate 53 opens two first avoiding holes 521 spaced from each other. The middle of the rear end of the bottom plate 54 opens two second avoiding holes 522 spaced from each other.

Referring to FIG. 1 to FIG. 6, the waterproof housing 60 is made of a waterproof material. The waterproof housing 60 is made of silicone. The silicone has advantages of an excellent high and low temperature resistance performance, an excellent water resistance performance, an excellent high-frequency insulation performance, an excellent radiation resistance performance and an excellent ozone resistance performance. When the waterproof housing 60 is molded by the silicone, the waterproof housing 60 has advantages of an excellent mobility performance and a slower hardening speed performance. The waterproof housing 60 is integrally molded outside the metal shell 50 by a liquid silicone rubber (LSR) technology. The waterproof housing 60 includes a main portion 61 and a partition portion 62. The main portion 61 of the waterproof housing 60 surrounds outside the metal shell 50.

The partition portion 62 of the waterproof housing 60 is integrally molded in the penetrating groove 1211 and the avoiding groove 31 by virtue of the silicone flowing into the penetrating groove 1211 and the avoiding groove 31 through the at least one first avoiding hole 521 and the at least one second avoiding hole 522, so that the partition portion 62 fills in and effectively seals up intervals among the rear ends of the fastening portions 201 and the insulating housing 10 which are located in the metal shell 50 for further ensuring a waterproof function of the insertion space 70 of the waterproof connector 100 is normal. The partition portion 62 blocks the rear surface of the dielectric body 11. In this preferred embodiment, the partition portion 62 of the waterproof housing 60 is integrally molded in the penetrating groove 1211 and the avoiding groove 31 by virtue of the silicone flowing into the penetrating groove 1211 and the avoiding groove 31 through the two first avoiding holes 521 and the two second avoiding holes 522. The waterproof connector 100 is applied to an electronic product (not shown). The waterproof housing 60 has multiple sealing rings 63 of which each surrounds a periphery of a front end of the waterproof housing 60. The main portion 61, the partition portion 62 and the multiple sealing rings 63 are integrally molded by the liquid silicone rubber (LSR) technology. The multiple sealing rings 63 are longitudinally arranged in sequence and provide multiple waterproof protections so as to reinforce and ensure that a waterproof function between an outside of the waterproof connector 100 and an enclosure (not shown) of the electronic product (not shown) is normal. Because the waterproof housing 60 is made of the silicone, the waterproof function between the outside of the waterproof connector 100 and the enclosure (not shown) of the electronic product (not shown) is capable of being ensured.

The waterproof housing 60 has three sealing rings 63 longitudinally arranged in sequence for providing three waterproof protections so as to reinforce and ensure that the waterproof function between the outside of the waterproof connector 100 and the enclosure (not shown) of the electronic product (not shown) is normal. The sealing rings 63 are made by the liquid silicone rubber (LSR) technology. Structures of the sealing rings 63 are similar to structures of O-ring sealing rings. An assembling cost of the waterproof housing 60 is reduced on account of the sealing rings 63 being integrally molded with the main portion 61. A top surface of the waterproof housing 60 is plane for being capable of ensuring a smoothness and an assembly process stability of the waterproof connector 100 and being capable of increasing an adsorption area to make a suction nozzle adsorb the waterproof connector 100 more stably.

Referring to FIG. 1 to FIG. 7, the shielding plate assembly 40 is assembled to the outer insulating body 12 of the insulating housing 10. The shielding plate assembly 40 includes an inverted U-shaped upper shielding plate 41 and a U-shaped lower shielding plate 42. Two opposite sides of the upper shielding plate 41 open two buckling holes 411. Two opposite sides of the lower shielding plate 42 are punched outward to form two buckling pieces 421. The lower shielding plate 42 is mounted to a lower portion and two opposite sides of the limiting groove 1223 of the outer insulating body 12. The upper shielding plate 41 is mounted to an upper portion and the two opposite sides of the limiting groove 1223 of the outer insulating body 12. The two opposite sides of the upper shielding plate 41 are attached to the two opposite sides of the lower shielding plate 42. The upper shielding plate 41 is fastened with the lower shielding plate 42 by virtue of a buckling way. The two buckling pieces 421 are buckled in the two buckling holes 411, respectively. The lower shielding plate 42 of the shielding plate assembly 40 abuts against an inner surface of the bottom plate 54 of the metal shell 50.

Referring to FIG. 1 to FIG. 7, the waterproof connector 100 further includes a soldering element 80. The soldering element 80 includes a board-shaped connecting portion 81, and two soldering slices 82 bent downward from two opposite sides of the connecting portion 81. The connecting portion 81 of the soldering element 80 is soldered to a portion of a top surface of a top plate of the metal shell 50 which is located in front of the at least one first avoiding hole 521. The connecting portion 81 of the soldering element 80 is soldered to the top surface of the top plate of the metal shell 50 by a laser spot welding way. The two soldering slices 82 penetrate downward through two opposite sides of the waterproof housing 60 and project beyond bottom surfaces of the two opposite sides of the waterproof housing 60.

As described above, the waterproof housing 60 is integrally molded outside the metal shell 50 by the liquid silicone rubber (LSR) technology, the main portion 61 of the waterproof housing 60 surrounds outside the metal shell 50, the waterproof housing 60 has the multiple sealing rings 63 of which each surrounds the periphery of the front end of the waterproof housing 60, the multiple sealing rings 63 are longitudinally arranged in sequence and provide the multiple waterproof protections so as to reinforce and ensure that the waterproof function between the outside of the waterproof connector 100 and the enclosure of the electronic product is normal. Simultaneously, the partition portion 62 of the waterproof housing 60 is integrally molded in the penetrating groove 1211, so that the partition portion 62 fills in and effectively seals up the intervals among the rear ends of the fastening portions 201 and the insulating housing 10 which are located in the metal shell 50 for further ensuring the waterproof function of the insertion space 70 of the waterproof connector 100 is normal. As a result, moistures and liquids in a usage environment are ensured to be prevented from permeating into the waterproof connector 100 to affect an electrical characteristic and a usage life of the waterproof connector 100.

What is claimed is:

1. A waterproof connector, comprising:

an insulating housing, a rear of the insulating housing opening a penetrating groove vertically penetrating through the insulating housing;

a plurality of terminals integrally molded to the insulating housing, each of the plurality of the terminals having a fastening portion, a contact portion connected with a front end of the fastening portion, and a soldering portion connected with a rear end of the fastening portion, the penetrating groove being opened corresponding to the rear ends of the fastening portions and located in front of the soldering portions;

a metal shell surrounding the insulating housing to which the plurality of the terminals are integrally molded; and a waterproof housing integrally molded outside the metal shell by a liquid silicone rubber technology, the waterproof housing including a main portion surrounding outside the metal shell, and a partition portion integrally molded in the penetrating groove, so that the partition portion fills in and effectively seals up intervals among the rear ends of the fastening portions and the insulating housing which are located in the metal shell, the waterproof housing having multiple sealing rings of which each surrounds a periphery of a front end of the waterproof housing, the main portion, the partition portion and the multiple sealing rings being integrally molded as a one-piece structure by the liquid silicone rubber technology.

2. The waterproof connector as claimed in claim 1, wherein the multiple sealing rings are longitudinally arranged in sequence.

3. The waterproof connector as claimed in claim 1, wherein the insulating housing includes a dielectric body and an outer insulating body, the outer insulating body has a base portion, and a tongue portion protruded frontward from a middle of a front surface of the base portion, a middle of a front of the base portion opens a receiving space extending frontward into a middle of a rear of the tongue portion, a front of a bottom surface of the tongue portion opens an opening communicated with the receiving space, the dielectric body is molded in the opening and the receiving space.

4. The waterproof connector as claimed in claim 3, wherein the plurality of the terminals include a plurality of lower terminals arranged transversely, and a plurality of upper terminals arranged transversely, the waterproof connector further includes an isolating plate disposed above the plurality of the lower terminals, the isolating plate and the plurality of the lower terminals are together integrally molded to the dielectric body, the plurality of the upper terminals are disposed above the isolating plate, the plurality of the upper terminals together with the dielectric body, the isolating plate and the plurality of the lower terminals are together integrally molded in the outer insulating body, the isolating plate is located between the plurality of the upper terminals and the plurality of the lower terminals.

5. The waterproof connector as claimed in claim 4, wherein the base portion opens the penetrating groove penetrating through a top surface and a bottom surface of the base portion, the penetrating groove is located at a rear end of the dielectric body, the isolating plate opens an avoiding groove corresponding to the penetrating groove, the partition portion of the waterproof housing is integrally molded in the penetrating groove and the avoiding groove by virtue of silicone flowing into the penetrating groove and the avoiding groove.

6. The waterproof connector as claimed in claim 5, wherein the metal shell surrounds the insulating housing to which the plurality of the terminals and the isolating plate are integrally molded, the metal shell has a top plate, and a bottom plate opposite to the top plate, a middle of a rear end of the top plate opens at least one first avoiding hole, a middle of a rear end of the bottom plate opens at least one second avoiding hole, the partition portion of the waterproof housing is integrally molded in the penetrating groove and the avoiding groove by virtue of the silicone flowing into the penetrating groove and the avoiding groove through the at least one first avoiding hole and the at least one second avoiding hole.

7. The waterproof connector as claimed in claim 6, wherein two opposite sides of a rear of the metal shell protrude downward to form two soldering feet, the waterproof connector further includes a soldering element which includes a board-shaped connecting portion, and two soldering slices bent downward from two opposite sides of the connecting portion, the connecting portion is soldered to a portion of a top surface of the top plate of the metal shell which is located in front of the at least one first avoiding hole, the two soldering slices penetrate downward through two opposite sides of the waterproof housing and project beyond bottom surfaces of the two opposite sides of the waterproof housing.

8. The waterproof connector as claimed in claim 7, wherein the connecting portion of the soldering element is soldered to the top surface of the top plate of the metal shell by a laser spot welding way.

9. The waterproof connector as claimed in claim 4, wherein each of the lower terminals has a lower fastening portion, a lower contact portion connected with a front end of the lower fastening portion, and a lower soldering portion connected with a rear end of the lower fastening portion, the dielectric body defines a plurality of lower terminal grooves penetrating through a bottom surface and a rear surface of the dielectric body, the lower contact portions of the plurality of the lower terminals are exposed to the plurality of the lower terminal grooves, the front ends of the lower fastening portions of the plurality of the lower terminals are integrally molded in the dielectric body, the rear ends of the lower fastening portions and the lower soldering portions of the plurality of the lower terminals project beyond the rear surface of the dielectric body.

10. The waterproof connector as claimed in claim 9, wherein each of the plurality of the upper terminals has an upper fastening portion, an upper contact portion connected with a front end of the upper fastening portion, and an upper soldering portion connected with a rear end of the upper fastening portion, the outer insulating body opens a plurality of upper terminal grooves penetrating through a front of a top surface of the tongue portion and extending to a front of the base portion, the plurality of the upper terminal grooves are communicated with the receiving space, the upper contact portions of the plurality of the upper terminals are exposed to the plurality of upper terminal grooves, the rear ends of the lower fastening portions of the plurality of the lower terminals are integrally molded in the outer insulating body, the upper soldering portions of the plurality of the upper terminals project under a rear of the outer insulating body.

11. The waterproof connector as claimed in claim 10, wherein a rear of a bottom surface of the base portion is recessed inward to form an assembling groove, the upper soldering portions of the plurality of the upper terminals and the lower soldering portions of the plurality of the lower terminals project under a rear of the outer insulating body and are exposed to the assembling groove.

12. The waterproof connector as claimed in claim 11, wherein an upper portion of a rear of the base portion opens a plurality of upper fixing holes arranged transversely and communicated with the penetrating groove, the plurality of the upper fixing holes vertically penetrate through a rear of a top wall of the assembling groove, a lower portion of the rear of the base portion opens a plurality of lower fixing holes arranged transversely and communicated with the penetrating groove, the plurality of the lower fixing holes vertically penetrate through a front of the top wall of the assembling groove, tail ends of the lower fixing holes are located in front of tail ends of the upper fixing holes, the upper soldering portions of the plurality of the upper terminals and the lower soldering portions of the plurality of the lower terminals pass through the plurality of the upper fixing holes and the plurality of the lower fixing holes, respectively.

13. The waterproof connector as claimed in claim 9, wherein bottom walls of the plurality of the lower terminal grooves open a plurality of locating holes vertically penetrating through the bottom walls of the plurality of the lower terminal grooves, several portions of a bottom surface of a top wall of the opening protrude downward to form a plurality of locating portions, the plurality of the locating portions are located in the plurality of the locating holes.

14. The waterproof connector as claimed in claim 3, wherein a front of the metal shell is spaced from the dielectric body and the tongue portion of the outer insulating body to form an insertion space.

15. The waterproof connector as claimed in claim 3, wherein the partition portion blocks a rear surface of the dielectric body.

16. The waterproof connector as claimed in claim 3, wherein a rear of a peripheral surface of the tongue portion is recessed inward to form a limiting groove, the shielding plate assembly further includes an inverted U-shaped upper shielding plate and a U-shaped lower shielding plate, the lower shielding plate is mounted to a lower portion and two opposite sides of the limiting groove, the upper shielding plate is mounted to an upper portion and the two opposite sides of the limiting groove, two opposite sides of the upper shielding plate are attached to two opposite sides of the lower shielding plate, the upper shielding plate is fastened with the lower shielding plate by virtue of a buckling way, the lower shielding plate abuts against an inner surface of a bottom plate of the metal shell.

17. The waterproof connector as claimed in claim 16, wherein the two opposite sides of the upper shielding plate open two buckling holes, the two opposite sides of the lower shielding plate are punched outward to form two buckling pieces, the two buckling pieces are buckled in the two buckling holes, respectively.

18. The waterproof connector as claimed in claim 1, wherein the waterproof housing is made of a waterproof material.

* * * * *